US008305329B2

(12) United States Patent
Chen et al.

(10) Patent No.: US 8,305,329 B2
(45) Date of Patent: Nov. 6, 2012

(54) INTEGRATED GATE DRIVER CIRCUIT AND DRIVING METHOD THEREFOR

(75) Inventors: Yan Jou Chen, Tainan County (TW); Yung Hsin Lu, Pingzhen (TW); Chia Hua Yu, Banciao (TW); Sung Chun Lin, Tainan (TW)

(73) Assignee: HannStar Display Corp., Taipei (TW)

( * ) Notice: Subject to any disclaimer, the term of this patent is extended or adjusted under 35 U.S.C. 154(b) by 527 days.

(21) Appl. No.: 12/560,771

(22) Filed: Sep. 16, 2009

(65) Prior Publication Data

US 2010/0073065 A1 Mar. 25, 2010

(30) Foreign Application Priority Data

Sep. 19, 2008 (TW) ..... 97135947 A

(51) Int. Cl.
*G09G 3/36* (2006.01)

(52) U.S. Cl. ..... 345/100; 327/419

(58) Field of Classification Search ..... None
See application file for complete search history.

(56) References Cited

U.S. PATENT DOCUMENTS

| | | | | |
|---|---|---|---|---|
| 5,222,082 | A | 6/1993 | Plus | |
| 6,339,631 | B1 * | 1/2002 | Yeo et al. | 377/64 |
| 6,970,530 | B1 * | 11/2005 | Wang et al. | 377/69 |
| 7,489,758 | B2 * | 2/2009 | Lan | 377/64 |
| 7,529,333 | B2 * | 5/2009 | Kim et al. | 377/64 |
| 7,532,701 | B2 * | 5/2009 | Moon | 377/68 |
| 2009/0051639 | A1 * | 2/2009 | Liu et al. | 345/92 |

* cited by examiner

*Primary Examiner* — Jason Olson
(74) *Attorney, Agent, or Firm* — Lowe, Hauptman, Ham & Berner, LLP

(57) ABSTRACT

An integrated gate driver circuit receives a plurality of clocks and includes a plurality of driving units cascaded in series. Each driving unit is for driving a load and includes an input terminal, an output terminal, a first switch and a second switch. The first switch has a first terminal coupled to the input terminal, a second terminal coupled to a first node, and a control terminal receiving a first clock, and the first switch is turned on when the first clock is at high level. The second switch has a first terminal receiving a second clock, a second terminal coupled to the output terminal, and a control terminal coupled to the first node, wherein the second clock charges and discharges the load through the second switch when the first node is at high level; wherein the output terminal of each driving unit is coupled to the input terminal of the immediately succeeding driving unit.

16 Claims, 5 Drawing Sheets

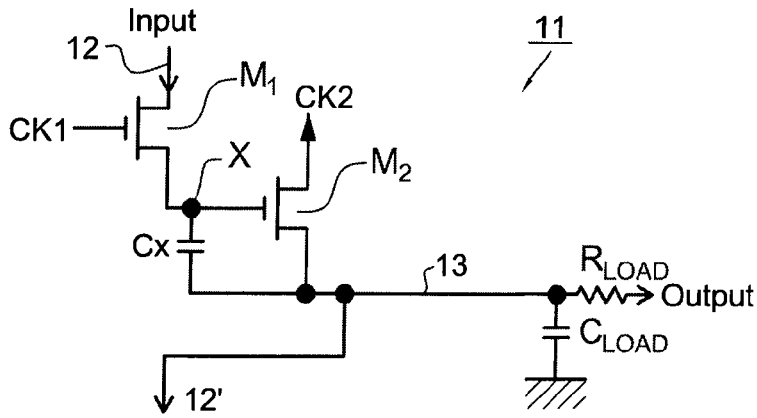
FIG 4
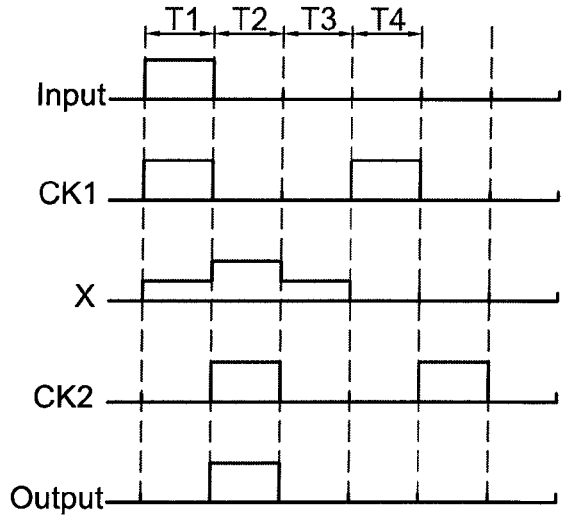
FIG 5a
| | T1 | T2 | T3 | T4 |
|---|---|---|---|---|
| $M_1$ | ON | OFF | OFF | ON |
| $M_2$ | ON | ON | ON | OFF |
FIG 5b

INTEGRATED GATE DRIVER CIRCUIT AND DRIVING METHOD THEREFOR

CROSS REFERENCE TO RELATED APPLICATION

This application claims the priority benefit of Taiwan Patent Application Serial Number 097135947, filed on Sep. 19, 2008, the full disclosure of which is incorporated herein by reference.

BACKGROUND

1. Field of the Invention

This invention generally relates to a gate driver circuit and, more particularly, to an integrated gate driver circuit for a liquid crystal display.

2. Description of the Related Art

A liquid crystal display 9 generally includes a pixel matrix 91, a plurality of gate driver circuits 92 and a plurality of source driver circuits 93, as shown in FIG. 1*a*. The pixel matrix 91 includes a plurality of gate lines, a plurality of data lines and pixels (not shown) located at the crossovers of the gate lines and the data lines. Each gate driver circuit 92 is coupled to a row of pixels through a gate line for sequentially providing a scanning signal to the pixel matrix 91. The source driver circuit 93 is coupled to a column of pixels for providing gray scales to be displayed to every pixels enabled by the scanning signal.

In order to improve the images displayed by a liquid crystal display, the resolution of the liquid crystal display is increased rapidly. Therefore, the number of driver circuits is increased and the manufacturing cost is also increase at the same time. Please refer to FIG. 1*b*, it has been known that simultaneously forming the gate driver circuits and the pixel matrix 91 onto one substrate, called integrated gate driver circuit 92', can reduce the manufacturing cost. However, because great numbers of gate lines, data lines and pixels have to be formed simultaneously on one substrate, limited space is available for forming the gate driver circuits thereon. Therefore, the structure of gate driver circuits 92' should be designed as simple as possible thereby increasing the manufacturing yield.

U.S. Pat. No. 5,222,082, entitled "SHIFT REGISTER USEFUL AS A SELECT LINE SCANNER FOR LIQUID CRYSTAL DISPLAY", disclosed a conventional integrated gate driver circuit includes a plurality of driving stages cascaded in series. Each driving stage includes an input terminal, an output terminal and an output circuit. The output circuit is for switching the voltage of the output terminal between high and low states. A first node switches the output terminal in response to an input signal, and a second node keeps the output terminal low between the input pulse and a clocking pulse. However, since each driving stage of the shift register still includes six thin film transistors, the shift register has complicated structure and needs larger manufacturing space.

Accordingly, the present invention further provides an integrated gate driver circuit, which can significantly reduce the complexity of circuit structure, manufacturing space and manufacturing cost.

SUMMARY

The present invention provides an integrated gate driver circuit, wherein each driving unit only needs two switching devices such that it has simpler circuit structure and lower manufacturing cost and needs less circuit space.

The present invention further provides an integrated gate driver circuit, wherein the charging and discharging to the output voltage of each driving unit are performed through the same switching device so as to eliminate the shift of the critical voltage of switching devices.

The present invention further provides an integrated gate driver circuit, wherein each driving unit can operate in conjunction with a voltage stabilizing circuit so as to stabilize the output voltage of the integrated gate driver circuit.

The present invention provides an integrated gate driver circuit receiving a plurality of clocks and including a plurality of driving units cascaded in series. Each driving unit is for driving a load and includes a signal input terminal, an output terminal, a first switch and a second switch. The first switch has a first terminal coupled to the signal input terminal, a second terminal coupled to a first node, and a control terminal receiving a first clock, and the first switch is turned on when the first clock is at high level. The second switch has a first terminal receiving a second clock, a second terminal coupled to the output terminal, and a control terminal coupled to the first node, wherein the second clock charges and discharges the load through the second switch when the first node is at high level; wherein the output terminal of each driving unit is coupled to the input terminal of the immediately succeeding driving unit.

The integrated gate driver circuit of the present invention may further include a capacitor coupled to between the second terminal of the first switch and the second terminal of the second switch, and a voltage stabilizing circuit coupled to between the second terminal of the second switch and the output terminal.

According to another aspect of the present invention, there is provided a gate driver circuit having a signal input terminal and an output terminal, and being composed of a first switch and a second switch. The first switch has a first terminal coupled to the signal input terminal, a second terminal coupled to a node, and a control terminal receiving a first clock, and the first switch is turned on when the first clock being at high level. The second switch has a first terminal receiving a second clock, a second terminal coupled to the output terminal, and a control terminal coupled to the node, wherein the second switch is turned on when the node is at high level thereby coupling the second clock to the output terminal.

According to another aspect of the present invention, there is provided a gate driver circuit for driving a load. The gate driver circuit includes a signal input terminal, an output terminal, a first switch and a second switch. The first switch has a first terminal coupled to the signal input terminal, a second terminal coupled to a node, and a control terminal receiving a first clock, and the first switch is turned on when the first clock is at high level. The second switch has a first terminal receiving a second clock, a second terminal coupled to the output terminal, and a control terminal coupled to the node, wherein the second clock charges and discharges the load through the second switch when the node is at high level.

According to another aspect of the present invention, there is provided a driving method for an integrated gate driver circuit. The integrated gate driver circuit includes a plurality of driving units cascaded in series. Each driving unit is for driving a load and includes a signal input terminal, an output terminal, a first switch and a second switch. The driving method includes the steps of: coupling a first clock to the first switch of a driving unit, turning on the first switch when the first clock being at high level thereby coupling an input signal from the signal input terminal of the driving unit, through the first switch, to a node; coupling a second clock to the second switch of the driving unit, turning on the second switch when the voltage of the node being at high level thereby coupling the second clock, through the second switch, to the output terminal so as to output an output signal to charge and discharge the load; and coupling the output signal to the signal input terminal of the immediately succeeding driving unit.

In the integrated gate driver circuit of the present invention, the clocks are provided by a clock generator, which may be included or not included in the integrated gate driver circuit. Furthermore, the clock generator may provide three or five clocks.

BRIEF DESCRIPTION OF THE DRAWINGS

Other objects, advantages, and novel features of the present invention will become more apparent from the following detailed description when taken in conjunction with the accompanying drawings.

FIG. 4 shows a circuit diagram of the first driving unit according to the first embodiment of the present invention.

FIG. 5*a* shows a timing diagram of the signals in the first driving unit shown in FIG. 4.

FIG. 5*b* shows operational states of the first switch and the second switch in accordance with FIG. 5*a*.

DETAILED DESCRIPTION OF THE EMBODIMENT

It should be noticed that, wherever possible, the same reference numbers will be used throughout the drawings to refer to the same or like parts.

Figure 1A:
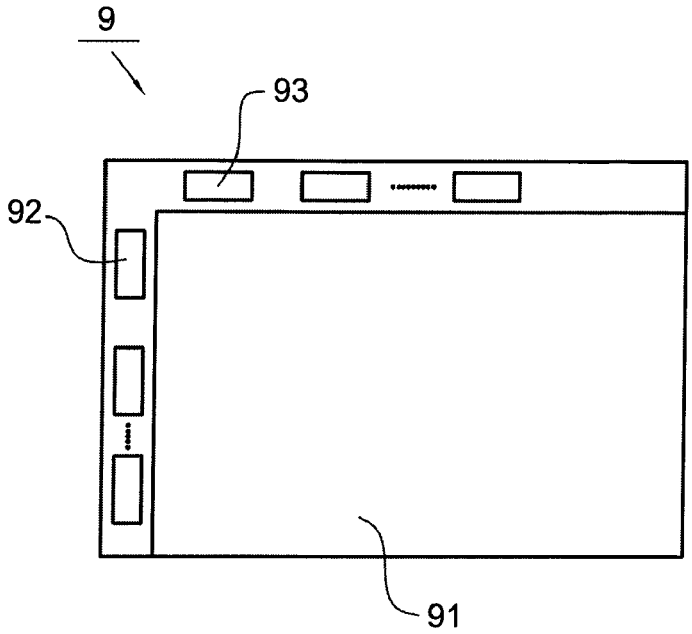
FIG. 1*a* shows a block diagram of a conventional liquid crystal display.
Figure 1B:
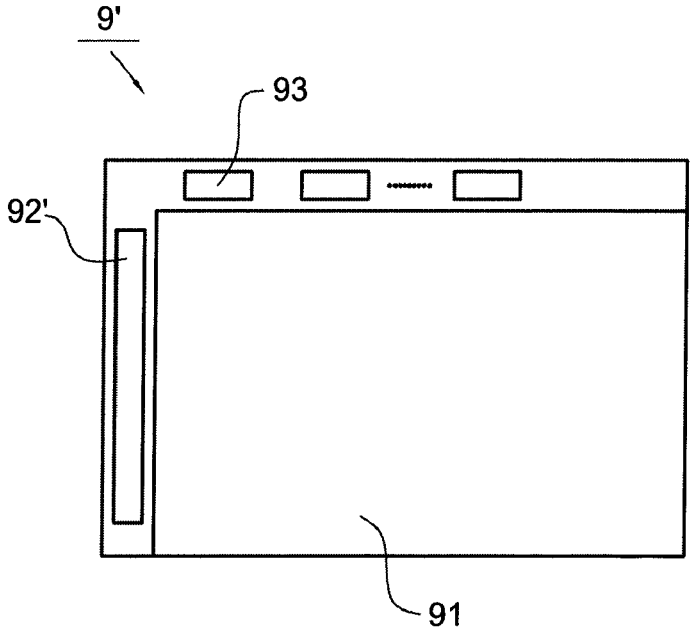
FIG. 1*b* shows a block diagram of another conventional liquid crystal display, wherein the gate driver circuit of the liquid crystal display is an integrated gate driver circuit.
Figure 2A:
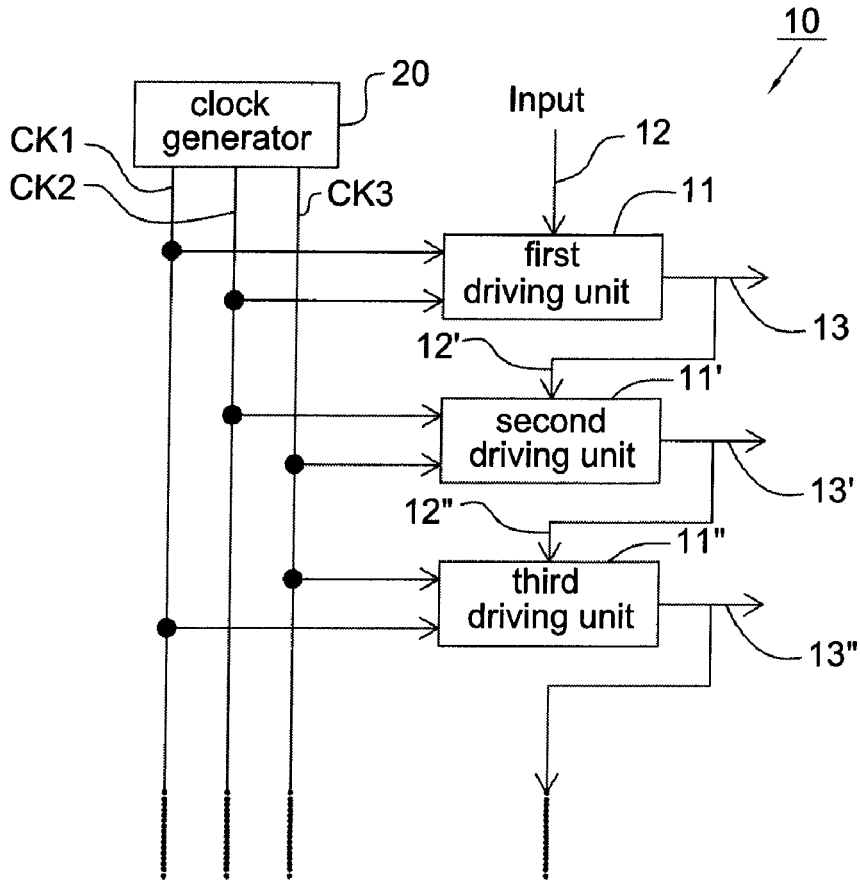
FIG. 2*a* shows a block diagram of the integrated gate driver circuit utilizing three clocks according to an embodiment of the present invention.

Please refer to FIG. 2*a*, it shows a block diagram of the integrated gate driver circuit 10 according to an embodiment of the present invention. The integrated gate driver circuit 10 includes a plurality of driving units cascaded in series, e.g. a first driving unit 11 (served as the first stage of all driving units), a second driving unit 11' and a third driving unit 11" as shown in the figure, and receives an input signal and a plurality of clocks, wherein the clocks are provided by a clock generator 20, which may be included or not included in the integrated gate driver circuit 10.

Each driving unit, e.g. the first driving unit 11 includes a signal input terminal 12 and an output terminal 13, and receives two clocks CK1 and CK2. The output terminal of each driving unit is coupled to the signal input terminal of the immediately succeeding driving unit. For example, the output terminal 13 of the first driving unit 11 is coupled to the signal input terminal 12' of the second driving unit 11'; the output terminal 13' of the second driving unit 11' is coupled to the signal input terminal 12" of the third driving unit 11". As the first driving unit 11 is served as the first stage of all cascaded driving units herein, the signal input terminal 12 of the first driving unit 11 receives the input signal received by the integrated gate driver circuit 10.

Figure 2B:
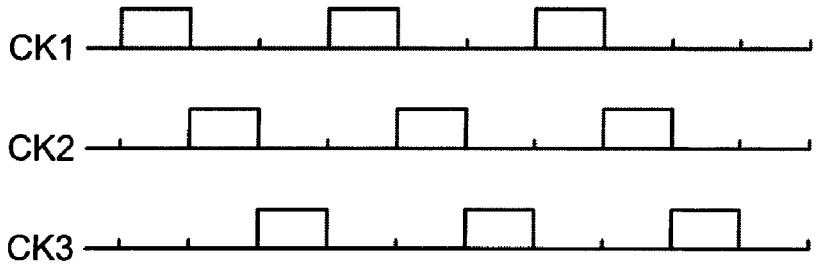
FIG. 2*b* shows a timing diagram of the clocks generated by the clock generator shown in FIG. 2*a*.

Please refer to FIG. 2*b*, it shows a timing diagram of the clocks received by the integrated gate driver circuit 10 according to the embodiment of the present invention. The clock generator 20 herein generators three clocks CK1, CK2 and CK3, and there is a phase shift, e.g. a clock pulse, between these clocks.

Figure 3A:
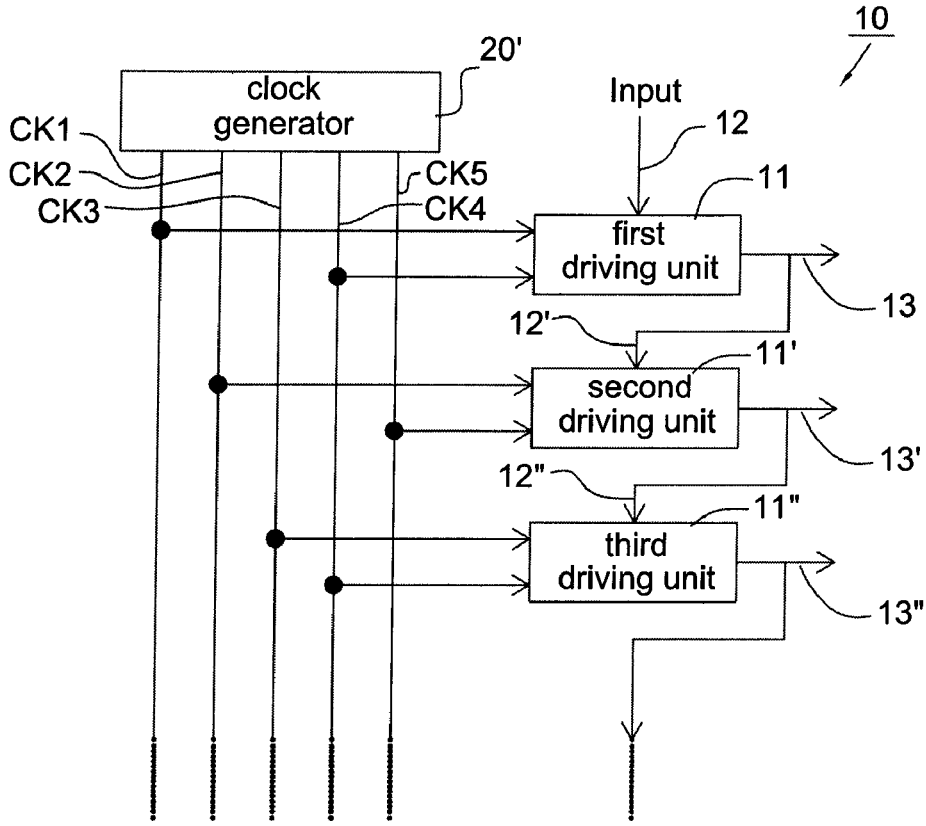
FIG. 3*a* shows a block diagram of the integrated gate driver circuit utilizing five clocks according to an embodiment of the present invention.

Please refer to FIG. 3*a*, it shows a block diagram of the integrated gate driver 10 according to an alternative embodiment of the present invention. The integrated gate driver circuit 10 also includes a plurality of driving units cascaded in series, and receives an input signal and a plurality of clocks. The difference between FIG. 2*a* and FIG. 3*a* is that, the integrated gate driver circuit 10, in this embodiment, receives five clocks provided by a clock generator 20'. Similarly, the clock generator 20' may be included or not included in the integrated gate driver circuit 10.

Figure 3B:
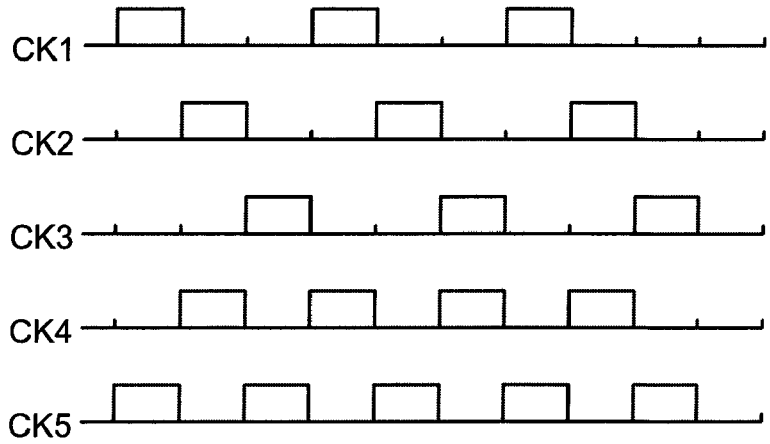
FIG. 3*b* shows a timing diagram of the clocks generated by the clock generator shown in FIG. 3*a*.

Please refer to FIG. 3*b*, it shows a timing diagram of the clocks received by the integrated gate driver circuit 10 according to the alternative embodiment of the present invention. The clock generator 20' herein generators five clocks CK1, CK2, CK3, CK4 and CK5, wherein there is a phase shift, e.g. a clock pulse, between the clocks CK1, CK2 and CK3; a frequency of the clocks CK4 and CK5 is 1.5 times of that of the clocks CK1, CK2 and CK3, and there is a phase shift, e.g. a clock pulse, between the clocks CK4 and CK5.

Please refer to FIG. 4, it shows a circuit diagram of one driving unit of the integrated gate driver circuit 10 according to the embodiment of the present invention, and the first driving unit 11 is used as an example herein for illustration. The first driving unit 11 has a signal input terminal 12, an output terminal 13, a first switch $M_1$ and a second switch $M_2$, wherein the first switch $M_1$ and the second switch $M_2$ may be thin film transistors or semiconductor switching devices. The first driving unit 11 is for driving a row of pixels, which is equalized by a resistor $R_{LOAD}$ and a capacitor $C_{LOAD}$ herein. The first switch $M_1$ has a first terminal coupled to the signal input terminal 12 for receiving the input signal of the integrated gate driver circuit 10, a second terminal coupled to a first node "X", and a control terminal for receiving the clock CK1. The second switch $M_2$ has a first terminal for receiving the second clock CK2, a second terminal coupled to the output terminal 13, and a control terminal coupled to the first node "X". Furthermore, the output terminal 13 of the first driving unit 11 is coupled to the signal input terminal 12' of the second driving unit 11'; therefore, an output signal from the first driving unit 11 is served as the input signal of the second driving unit 11'. Furthermore, the integrated gate driver circuit 10 may further include a capacitor "Cx" coupled to between the first mode "X" and the output terminal 13 so as to reduce the coupling between stray capacitors of the first and second switches $M_1$, $M_2$ and signals.

Please refer to FIGS. 5*a* and 5*b*, they show the driving method for the integrated gate driver circuit 10 according to the embodiment of the present invention. FIG. 5*a* shows a signal timing diagram, including the voltage of the signal input terminal 12, the first clock CK1, the voltage of the first node "X", the second clock KC2 and the voltage of the output terminal 13, for one driving unit, e.g. the first driving unit 11 of the integrated gate driver circuit 10, and FIG. 5*b* shows the operational states of the first switch $M_1$ and the second switch $M_2$ in accordance with FIG. 5*a*. In addition, for illustration, a resistor $R_{LOAD}$ and a capacitor $C_{LOAD}$ are used to equalize the load of the first driving unit 11. Furthermore, in the following illustrations, for example, a high level may be 15 volts and a low level may be −10 volts, but this is not to limit the present invention.

Firstly, during a first period T1, the signal input terminal 12 receives an input signal "Input" with high level and the first clock CK1 is also at high level. Accordingly, the first switch $M_1$ is turned on and the input signal "Input" is coupled to the first node "X" to charge the voltage of the first node "X" to high level. In this manner, the second switch $M_2$ is turned on and the second clock CK2 is coupled to the output terminal 13. In this time interval, as the second clock CK2 is at low level, the output terminal 13 outputs a low level output signal "Output".

During a second period T2, the input signal "Input" and the first clock CK1 are both at low level, and thus the first switch $M_1$ is turned off. For the existence of the stray capacitor of the second switch $M_2$, the voltage of the first node "X" is still at high level and thus the second switch $M_2$ is still turned on to continuously couple the second clock CK2 to the output terminal 13. In this time interval, as the second clock CK2 changes to high level, the load capacitor $C_{LOAD}$ of the output terminal 13 is charged to high level to output a high level output signal "Output". The output signal "Output" has a phase delay, e.g. a clock pulse, with respect to the input signal "Input".

During a third period T3, the input signal "Input" and the first clock CK1 are still at low level, such that the first switch $M_1$ is turned off. For the existence of the stray capacitor of the switch $M_2$, the voltage of the first node "X" is still at high level and thus the switch $M_2$ is still turned on to couple to second clock CK2 to the output terminal 13. In this time interval, as the second clock CK2 is at low level, the load capacitor $C_{LOAD}$ is discharged, through the second switch $M_2$, to low level to output a low level output signal "Output".

During a fourth period T4, the first clock CK1 is at high level to turn on the first switch $M_1$. In this time interval, as the input signal "Input" is at low level, the first node is discharged, through the first switch $M_1$, to low level to turn off the second switch $M_2$. As the load capacitor $C_{LOAD}$ was discharged to low level during the third period T3 and is not charged again during the fourth period T4, the output terminal 13 outputs a low level output signal "Output".

Since the driving unit of the present invention only uses two switches ($M_1$ and $M_2$), it is able to reduce the circuit complexity and needed circuit space. In addition, because the charging and discharging to the load capacitor $C_{LOAD}$ is performed through the same switch, it is able to further decrease the shift of the critical voltage of switching devices.

Figure 6:
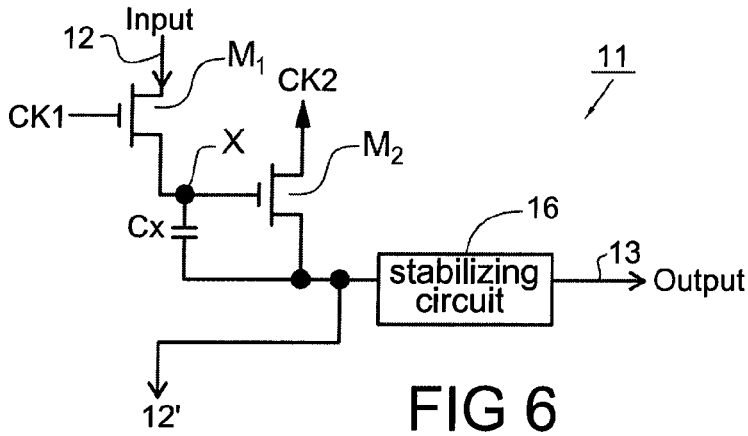
FIG. 6 shows a circuit diagram of the first driving unit according to the second embodiment of the present invention, wherein a voltage stabilizing circuit is further included therein.

Please refer to FIG. 6, it shows the integrated gate driver circuit 10 according to the second embodiment of the present invention. The integrated gate driver circuit 10 further includes a voltage stabilizing circuit 16 coupled to between the second terminal of the second switch $M_2$ and the output terminal 13 so as to reduce the ripple in the output signal "Output".

Figure 7A:
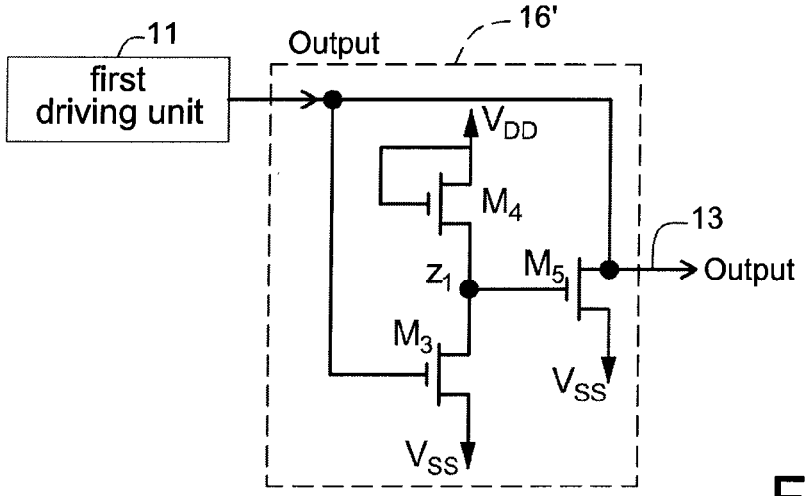
FIG. 7*a* shows an aspect of the voltage stabilizing circuit shown in FIG. 6.

Please refer to FIG. 7*a*, it shows an aspect of the voltage stabilizing circuit. The voltage stabilizing circuit 16' includes a third switch $M_3$, a fourth switch $M_4$ and fifth switch $M_5$, and these switches may be, for example, thin film transistors or semiconductor switching devices. The third switch $M_3$ has a first terminal coupled to a second node $Z_1$, a second terminal coupled to a first biasing voltage Vss, e.g. −10 volts, and a control terminal coupled to the output terminal 13. The fourth switch $M_4$ has a first terminal coupled to a second biasing voltage $V_{DD}$, e.g. 15 volts, a second terminal coupled to the second node $Z_1$, and a control terminal coupled to its first terminal. The fifth switch $M_5$ has a first terminal coupled to the output terminal 13, a second terminal coupled to the first biasing voltage Vss, and a control terminal coupled to the second node $Z_1$. When the voltage of the output terminal 13 is at low level, the third switch is turned off and the fourth switch $M_4$ is turned on so as to charge the second node $Z_1$ to high level to turn on the fifth switch $M_5$, and thus the voltage of the output terminal 13 can be maintained at low level. On the contrary, when the voltage of the output terminal 13 is at high level, the third switch $M_3$ and the fourth switch $M_4$ are both turned on to discharge the second node $Z_1$ to low level to turn off the fifth switch $M_5$, and thus the voltage of the output terminal 13 can be maintained at high level. In addition, it can be understood that the voltage stabilizing circuit 16' is coupled after the output terminal of each driving unit.

Figure 7B:
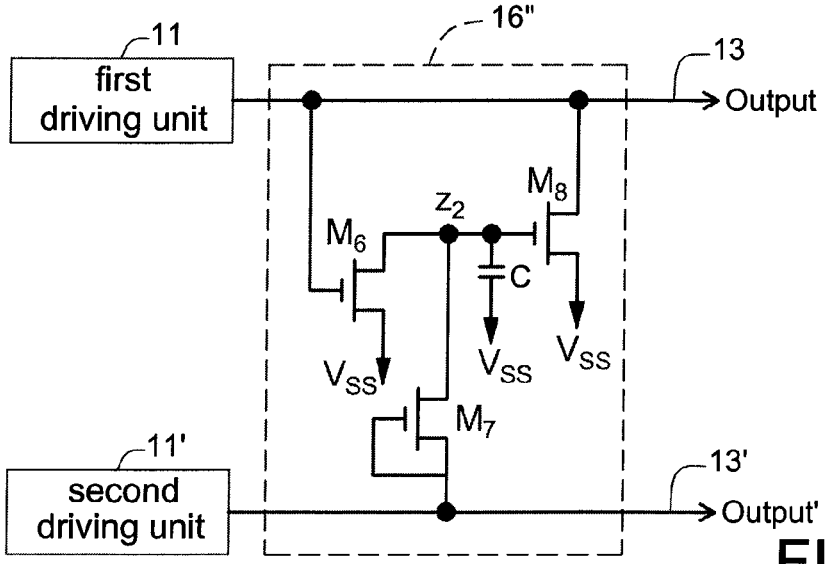
FIG. 7*b* shows another aspect of the voltage stabilizing circuit shown in FIG. 6.

Please refer to FIG. 7*b*, it shows another aspect of the voltage stabilizing circuit. The voltage stabilizing circuit 16" is coupled to between two adjacent driving units, e.g. between the output terminal 13 of the first driving unit 11 and the output terminal 13' of the second driving unit 11'. The voltage stabilizing unit 16" includes a sixth switch $M_6$, a seventh switch $M_7$ and a eighth switch $M_8$, and these switches may be, for example, thin film transistors or semiconductor switching devices. The sixth switch $M_6$ has a first terminal coupled to a third node $Z_2$, a second terminal coupled to a first biasing voltage Vss, e.g. −10 volts, and a control terminal coupled to the output terminal 13 of the first driving unit 11. The seventh switch $M_7$ has a first terminal coupled to the third node $Z_2$, a second terminal coupled to the control terminal of the seventh switch $M_7$ and to the output terminal 13' of the second driving unit 11'. The eighth switch $M_8$ has a first terminal coupled to the output terminal 13 of the first driving unit 11, a second terminal coupled to the first biasing voltage Vss, and a control terminal coupled to the third node $Z_2$. It can be seen from FIG. 5*a*, in all cascaded driving units, a high level outputted from a driving unit has a phase delay with respect to that outputted from its immediately previous driving unit. Therefore, it is assumed herein that the outputs of the output terminal 13 of the first driving unit 11 are respectively 0100 (0 representing low level and 1 representing high level), and the outputs of the output terminal 13' of the second driving unit 11' are respectively 0010. Firstly, when the output terminal 13 is at high level but the output terminal 13' is at low level, the switch $M_6$ is turned on so as to discharge the third node $Z_2$ to low level to turn off the eighth switch $M_8$ and the seventh switch $M_7$, and thus the voltage of the output terminal 13 can be kept at high level. In the next period, the output terminal 13 is at low level but the output terminal 13' is at high level, the switch $M_6$ is turned off and the seventh switch $M_7$ is turned on so as to charge the third node $Z_2$ to high level to turn on the eighth switch $M_8$, and thus the voltage of the output terminal 13 can be kept at low level. In the next period, the output terminals 13 and 13' are both at low level to turn off the sixth switch $M_6$ and the seventh switch $M_7$. In this time interval, the voltage of the third node $Z_2$ is still at high level to turn on the eighth switch $M_8$, and thus the voltage of the output terminal 13 can be kept at low level. It can be appreciated from above descriptions that the output terminal 13 of the first driving unit 11 can keep at high level output till the voltage of the output terminal 13' of the second driving unit 11' becomes high level. Furthermore, the voltage stabilizing circuit may further include a capacitor "C" coupled to between the third node $Z_2$ and the first biasing voltage Vss.

As mentioned above, since an integrated gate driver circuit needs a simpler circuit structure and less manufacturing space, the present invention provides a driving unit of the integrated gate driver circuit with only two switching devices to significantly reduce the manufacturing cost. In addition, because the integrated gate driver circuit of the present invention charges and discharges the load through only one switch, it is able to eliminate the shift of the critical voltage of switching devices.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. An integrated gate driver circuit configured to receive a plurality of clocks and comprising a plurality of driving units cascaded in series, each driving unit being for driving a load and comprising:

a signal input terminal;

an output terminal;

a first switch, having a first terminal coupled to the signal input terminal, a second terminal coupled to a first node, and a control terminal configured to receive a first clock, the first switch being configured to be turned on when the first clock is at a high level;

a second switch, having a first terminal configured to receive a second clock, a second terminal coupled to the output terminal, and a control terminal coupled to the first node, wherein the second clock is for charging and discharging the load through the second switch when the first node is at a high level; and a voltage stabilizing circuit coupled between the second terminal of the second switch and the output terminal, wherein the voltage stabilizing circuit comprises a third switch, a fourth switch and a fifth switch, wherein the third switch has a first terminal coupled to a second node, a second terminal coupled to receive a first biasing voltage, and a control terminal coupled to the output terminal, wherein the fourth switch has a first terminal coupled to receive a second biasing voltage, a second terminal coupled to the second node, and a control terminal coupled to the first terminal of the fourth switch, wherein the fifth switch has a first terminal coupled to the output terminal, a second terminal coupled to receive the first biasing voltage, and a control terminal coupled to the second node, wherein the first biasing voltage is lower than the second biasing voltage, and wherein the output terminal of each driving unit is coupled to the signal input terminal of the immediately succeeding driving unit.

2. The integrated gate driver circuit as claimed in claim 1, further comprising a capacitor coupled between the first node and the second terminal of the second switch.

3. The integrated gate driver circuit as claimed in claim 1, wherein the first and second switches are thin film transistors.

4. The integrated gate driver circuit as claimed in claim 1, configured to receive the first clock, the second clock, and a third clock, wherein there is a predetermined phase shift between the first, second, and third clocks.

5. The integrated gate driver circuit as claimed in claim 1, configured to receive the first clock, the second clock, a third clock, a fourth clock and a fifth clock, wherein there is a predetermined phase shift between the first, second, third, fourth and fifth clocks, and a frequency of the fourth and fifth clocks is 1.5 times of that of the first, second and third clocks.

6. A gate driver circuit for driving a load, the gate driver circuit comprising:

a signal input terminal;

an output terminal;

a first switch, having a first terminal coupled to the signal input terminal, a second terminal coupled to a first node, and a control terminal configured to receive a first clock, the first switch being configured to be turned on when the first clock is at a high level;

a second switch, having a first terminal configured to receive a second clock, a second terminal coupled to the output terminal, and a control terminal coupled to the first node, wherein the second clock is for charging and discharging the load through the second switch when the first node is at a high level; and a voltage stabilizing circuit coupled between the second terminal of the second switch and the output terminal, wherein the voltage stabilizing circuit comprises a third switch, a fourth switch and a fifth switch, wherein the third switch has a first terminal coupled to a second node, a second terminal coupled to receive a first biasing voltage, and a control terminal coupled to the output terminal;

wherein the fourth switch has a first terminal coupled to receive a second biasing voltage, a second terminal coupled to the second node, and a control terminal coupled to the first terminal of the fourth switch, wherein the fifth switch has a first terminal coupled to the output terminal, a second terminal coupled to receive the first biasing voltage, and a control terminal coupled to the second node, and wherein the first biasing voltage is lower than the second biasing voltage.

7. The gate driver circuit as claimed in claim 6, further comprising a capacitor coupled between the first node and the second terminal of the second switch.

8. The gate driver circuit as claimed in claim 6, wherein there is a phase shift between the first clock and the second clock.

9. An integrated gate driver circuit configured to receive a plurality of clocks and comprising a plurality of driving units cascaded in series, each driving unit being for driving a load and comprising:

a signal input terminal;

an output terminal;

a first switch having a first terminal coupled to the signal input terminal, a second terminal coupled to a first node, and a control terminal configured to receive a first clock, the first switch being configured to be turned on when the first clock is at a high level;

a second switch having a first terminal configured to receive a second clock, a second terminal coupled to the output terminal, and a control terminal coupled to the first node, wherein the second clock is for charging and discharging the load through the second switch when the first node is at a high level; and a voltage stabilizing circuit coupled between the second terminal of the second switch and the output terminal, wherein the voltage stabilizing circuit further comprises a sixth switch, a seventh switch and an eighth switch, wherein the sixth switch has a first terminal coupled to a third node, a second terminal coupled to receive a first biasing voltage, and a control terminal coupled to the output terminal, wherein the seventh switch has a first terminal coupled to the third node, a second terminal coupled to the output terminal of the immediately succeeding driving unit, and a control terminal coupled to the second terminal of the seventh switch, wherein the eighth switch has a first terminal coupled to the output terminal, a second terminal coupled to receive the first biasing voltage, and a control terminal coupled to the third node, and wherein the output terminal of each driving unit is coupled to the signal input terminal of the immediately succeeding driving unit.

10. The integrated gate driver circuit as claimed in claim 9, further comprising a capacitor coupled between the first node and the second terminal of the second switch.

11. The integrated gate driver circuit as claimed in claim 9, wherein the first and second switches are thin film transistors.

12. The integrated gate driver circuit as claimed in claim 9, configured to receive the first clock, the second clock and a third clock, wherein there is a predetermined phase shift between the first, second, and third clocks.

13. The integrated gate driver circuit as claimed in claim 9, configured to receive the first clock, the second clock, a third clock, a fourth clock and a fifth clock, wherein there is a predetermined phase shift between the first, second, third, fourth and fifth clocks, and a frequency of the fourth and fifth clocks is 1.5 times of that of the first, second and third clocks.

14. A gate driver circuit for driving a load, the gate driver circuit comprising:

a signal input terminal;

an output terminal;

a first switch having a first terminal coupled to the signal input terminal, a second terminal coupled to a first node, and a control terminal configured to receive a first clock, the first switch being configured to be turned on when the first clock is at a high level;

a second switch having a first terminal configured to receive a second clock, a second terminal coupled to the output terminal, and a control terminal coupled to the first node, wherein the second clock is for charging and discharging the load through the second switch when the first node is at a high level; and a voltage stabilizing circuit coupled between the second terminal of the second switch and the output terminal, wherein the voltage stabilizing circuit further comprises a sixth switch, a seventh switch and an eighth switch, wherein the sixth switch has a first terminal coupled to a third node, a second terminal coupled to receive a first biasing voltage, and a control terminal coupled to the output terminal, wherein the seventh switch has a first terminal coupled to the third node, a second terminal coupled to the output terminal of the immediately succeeding driving unit, and a control terminal coupled to the second terminal of the seventh switch, wherein the eighth switch has a first terminal coupled to the output terminal, a second terminal coupled to receive the first biasing voltage, and a control terminal coupled to the third node.

15. The gate driver circuit as claimed in claim 14, further comprising a capacitor coupled between the first node and the second terminal of the second switch.

16. The gate driver circuit as claimed in claim 14, wherein there is a phase shift between the first and second clocks.

* * * * *